US005802977A

United States Patent [19]

Constantino et al.

[11] Patent Number: 5,802,977

[45] Date of Patent: Sep. 8, 1998

[54] LIQUID METERING ROLL

[76] Inventors: Ronald Constantino; Sharon Constantino, both of 4946 Dutch Hill Rd., Cincinnatus, N.Y. 13040

[21] Appl. No.: 874,072

[22] Filed: Jun. 12, 1997

Related U.S. Application Data

[62] Division of Ser. No. 391,575, Feb. 6, 1995, Pat. No. 5,660, 109.

[51] Int. Cl.[6] ..... B41F 31/26

[52] U.S. Cl. ..... 101/483; 101/348; 492/59

[58] Field of Search ..... 101/348, 349.1, 101/350.1, 207, 208, 209, 210, 363, 148, 483; 492/53, 57, 59

[56] References Cited

U.S. PATENT DOCUMENTS

| | | | |
|---|---|---|---|
| 3,847,260 | 11/1974 | Fowler | 492/59 |
| 4,198,739 | 4/1980 | Budinger et al. | 29/132 |
| 4,461,663 | 7/1984 | Tachibana et al. | 101/375 |
| 4,893,946 | 1/1990 | Tesh | 384/549 |
| 5,284,091 | 2/1994 | Kon et al. | 101/378 |

FOREIGN PATENT DOCUMENTS

| | | | |
|---|---|---|---|
| 2076274 | 3/1993 | Canada | 101/148 |

*Primary Examiner*—J. Reed Fisher
*Attorney, Agent, or Firm*—Clifford F. Frayne

[57] ABSTRACT

A metering roll for the application of ink or other liquids and a method of fabricating same wherein the metering roll has a core roll securable to journal bearings and rotatable about the journal bearings, the core roll having a non-porous cylindrical sleeve of heat resistant glass secured about it, the non-porous heat resistant glass sleeve having formed on the periphery thereof, ink capturing cells.

1 Claim, 1 Drawing Sheet

LIQUID METERING ROLL

This is a divisional of application Ser. No. 08/391,575, filed Feb. 6, 1995 U.S. Pat. No. 5,660,109.

BACKGROUND OF THE INVENTION

1. Field of the Invention

The present invention relates to the field of liquid metering rolls, and more particularly rolls for metering inks, adhesives or like fluids.

2. Description of the Prior Art

In the printing art, it is known to provide an ink neutering roll for the transfer of ink from a reservoir to the print roller. The ink roller comprises a cylindrical core having formed on its cylindrical outer surface, a plurality of spaced apart ink capturing cells. The quantity of ink deposited on the print roller is controlled by the tolerances associated with the cells, namely, their size, configuration and spacing. See U.S. Pat. No. 3,613,578. It will be appreciated that the construction of an ink metering roll with precisely shaped ink capturing cells formed in high concentrations is a costly apparatus from the standpoints of the procedures utilized to manufacture same. The cost is justified from the standpoint of the quality of printing which is achieved.

However, ink metering rolls are subject to corrosive attack as a result of the inks which are employed in the printing process and their particular pH, and are subject to rapid wear because of their continued use.

U.S. Pat. No. 4,009,658 to Heurich attempted to improve the life of the ink metering roll through the use of a plasma flame deposit procedure. Heurich taught to form the cylindrical core and engrave the plurality of ink capturing cells onto the core and thereafter subject the core to a flame deposit procedure in which a ceramic coating would be applied to the exposed surfaces of the core including the cell surfaces. While this has improved the life expectancy of the ink metering roller, it is an expensive, time-consuming process which does have certain drawbacks.

Once you have obtained a concentric roller that has been appropriately engraved with the ink capturing cells, a bonding coat utilizing 95-5 nickel must be applied to help anchor the subsequent ceramic, such as chrome oxide. The chrome oxide is sprayed on the roller utilizing the plasma flame deposit procedure, this procedure taking from 6 to 8 hours. Further, the procedure contributes to a waste of chrome oxide in the spraying procedure.

The coating, after application, does have some porosity so the corrosive attack on the underlying roller from the inks is not completely eliminated. Still further, it is oftentimes difficult to get a consistent coating about the entire periphery of the roll. Further, if contaminants are present in the spray, such as copper or a free chromium ion, it will be rejected by the roll and will result in uneven coating.

Even after the coating has been applied, and even if it has been applied consistently about the periphery of the roll, it still is subject to cracks and penetration if it comes into contact with a foreign object, stress cracking during operation if the roll overheats and delamination if any of the foregoing occur.

Applicant's invention eliminates the need for the application of a coating, and provides superior protection to possible corrosion of the underlying metal core due to the superior anti-porous nature of the roll and ensures a uniform cylinder onto which the ink capturing cells can be engraved in a lineal, cells per inch format greater than can be presently achieved. While Applicant has described the prior art as it related to liquid metering rolls for ink, metering rolls are also utilized to meter other liquids including adhesives and Applicant's invention would have similar application.

OBJECTS OF THE INVENTION

An object of the present invention is to provide for a novel metering roll for the metering of ink or other liquids which is impervious to the corrosivity of the inks or liquid utilized.

A further object of the present invention is to provide for a novel metering roll which is not susceptible to delamination or stress cracking.

A further object of the present invention is to provide for a novel metering roll which is easily fabricated in a consistent manner with repeatable qualities.

A further object of the present invention is to provide for a novel metering roll which is susceptible to receiving an increased number of liquid capturing cells per inch over the prior art.

A further object of the present invention is to provide for a novel metering roll which can be lighter in weight than existing metering rolls.

A still further object of the present invention is to provide for a novel metering roll which can be engraved by either laser, chemical or mechanical means.

SUMMARY OF THE INVENTION

A metering roll for the transfer of ink or other fluids, the metering roll having a core comprised of steel, carbon fiber, aluminum or other suitable material, formed in a cylindrical roll, the core having concentrically disposed about its periphery and secured thereto, a sleeve of glass onto which the ink or fluid capturing cells are engraved.

BRIEF DESCRIPTION OF THE DRAWINGS

These and other objects of the present invention will become evident, particularly when taken with the following illustrations wherein.

DETAILED DESCRIPTION OF THE DRAWINGS

Figure 1:
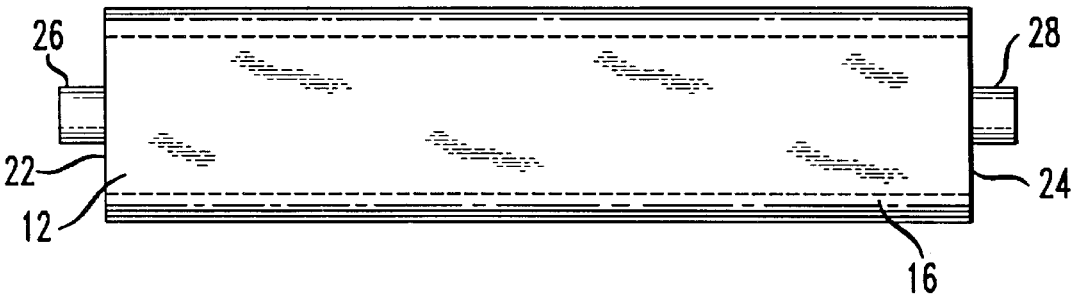
FIG. 1 is a front view of an ink metering roller.
Figure 2:
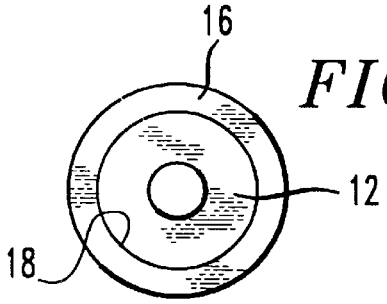
FIG. 2 is a side view of an ink metering roller.
Figure 3:
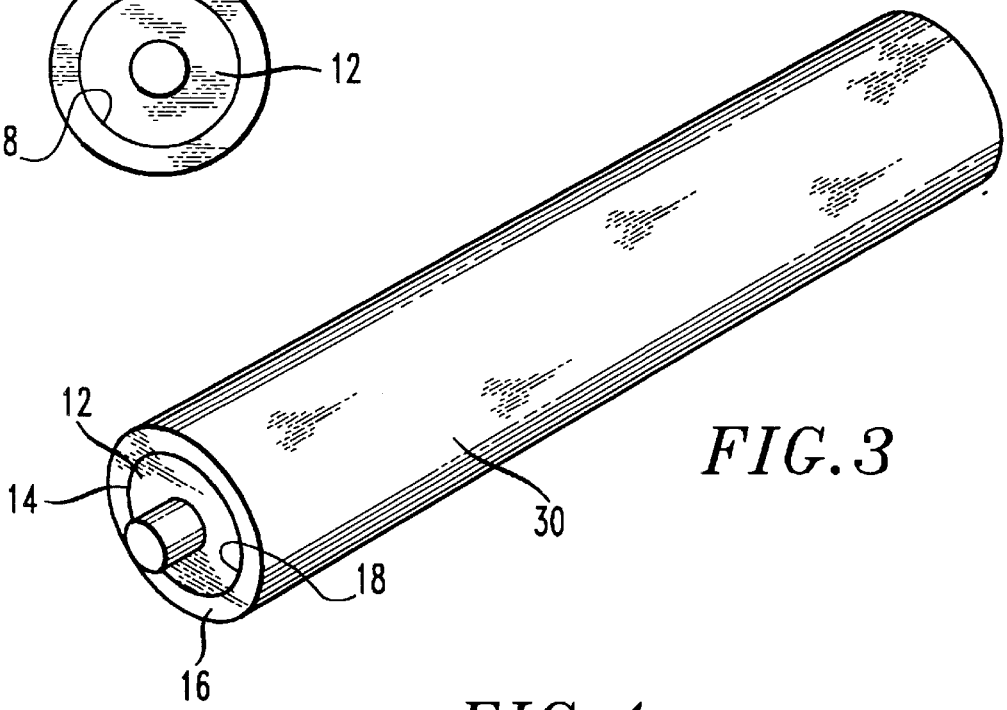
FIG. 3 is a perspective view of an ink metering roller.
Figure 4:
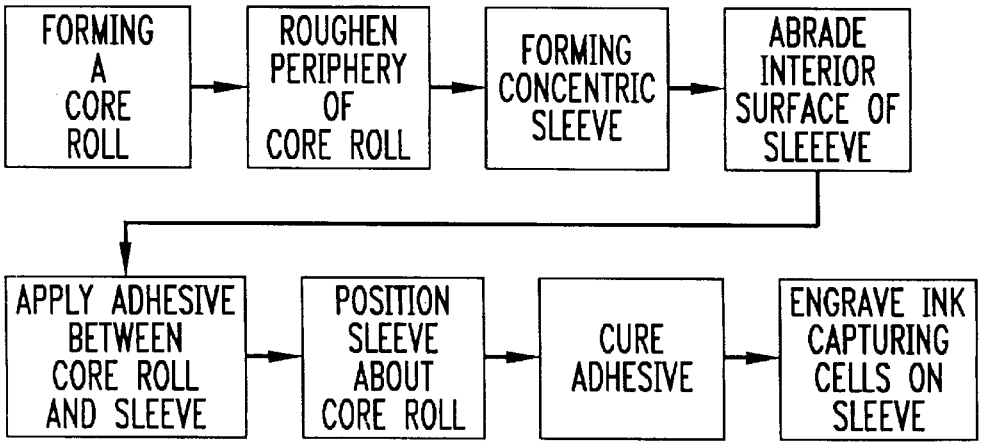
FIG. 4 is a block diagram for the process of assembling an ink metering roller in accordance with the invention described herein.

FIG. 1 is a front view of an ink metering roller 10 of the type described herein; FIG. 2 is a end view of the ink metering roller 10; and FIG. 3 is a perspective view of the ink metering roller 10. Ink metering roller 10 has a core roll 12 which is comprised of steel, aluminum or high density carbon fiber. Core roll 12 could be fabricated as a new roll for use with Applicant's ink metering roller 10 or core roll 12 could be an existing ink metering roll which had been used with the prior art technology. In either event, core roll 12 must be formed to the proper dimensions to ensure that its cylindrical periphery 14 is concentric throughout its length.

Concentrically positioned on core roll 12 is a glass sleeve 16 whose inner diameter 18 is equal to the outer diameter of core roll 12. Glass sleeve 16 is bonded to core roll 12 by one of two means. An adhesive 20 would be positioned on core roll 12 prior to its insertion into glass sleeve 16 or glass sleeve 16 can be heated and core roll 12 cooled to provide a tight interference fit. Core roll 12 would have positioned at ends 22 and 24, journals 26 and 28 for mounting the ink metering roll on the printing equipment. The glass sleeve, having superior hardness and low porosity, eliminates the shortcomings of the plasma flame deposit technique and the glass sleeve can be manufactured to extremely close tolerances for compatibility with the core roller 12. Typically, an ink metering roller can range from 6 inches to over 10 feet in length and up to 8 inches in diameter. Glass sleeve 16 can be fabricated in these lengths and in a wall thickness from 1/16th of an inch to 2 inches ±0.005 inches. Once the glass sleeve 16 is secured to core roller 12, the laser, chemical or mechanical engraving of ink capturing cells 30 can be performed on the outer surface of glass sleeve 16. Due to the hardness and low porosity of the glass sleeve 16, it will be possible to increase the number of ink capturing cells per inch by approximately a tenfold factor since consideration will not have to be taken for a chromium oxide coating to be sprayed on the roll once the engraving process is complete.

An ink metering roll of the type described requires several process steps to be performed in order to ensure its proper functioning on a printing machine. In the preferred procedure, the first step is to ensure that the core roll 12 is concentric throughout its length. The outer surface of core roll 12 is then treated to a grit blast in order to prepare the outer circumference for the adhesive and to permit the adhesive to secure to the outer circumference of core roll 12. Preferably, a G-16 steel grit would be utilized in the grit blasting process. The interior cylindrical periphery of glass sleeve 16 would be similarly prepared utilizing an oxide grit. Glass sleeve 16 would be positioned on rollers, causing glass sleeve 16 to spin about its longitudinal axis while oxide grit was introduced into the cylindrical interior of glass sleeve 16. The oxide grit would remove the shine from the interior cylindrical surface of glass sleeve 16 and also roughen the interior cylindrical surface of glass sleeve 16 to give it a texture so as to permit the adhesive to bond to the glass.

Once the core roll 12 and glass sleeve 16 had been so prepared, the adhesive would be applied to the outer cylindrical surface of the core roll 12 and the glass sleeve 16 would be slipped over core roll 12.

The adhesive utilized in this step must be carefully considered. Most adhesives contain solvents which evaporate in the curing process causing outgassing. Since the outer dimensions of core roll 12 and the inner diameter of glass sleeve 16 are substantially identical, any adhesive utilizing such a solvent would make the ink metering roller of the type described herein ineffective since the evaporation process would cause glass sleeve 16 to crack and break.

The preferred adhesive is an adhesive which is composed of 100% solids, having no solvents and hence no evaporation and no cracking or breaking of the glass sleeve. Further, the preferred adhesive should be set or cured through the utilization of ultraviolet light. This can be accomplished with respect to the ink metering roll of the present invention since the ink capturing surface is represented by the glass sleeve 16 which will permit the passage of ultraviolet light. Therefore, a 100% solid adhesive which sets after exposed to Ultraviolet (UV) light allows the operator to ensure that the glass sleeve 16 is properly positioned on core roll 12 without having to worry about the speed of his work, since the adhesive will not set or bond until the operator places a bank of ultraviolet lamps in proximity to the ink metering roller and turns the ink metering roller about its longitudinal axis exposing successive areas to the ultraviolet light and thus setting the adhesive.

A suitable adhesive is found to be Norland Optical Adhesive 88 manufactured by Norland Products, Inc. of New Brunswick, N.J. It is an optically clear liquid adhesive of 100% solid material which is cured by ultraviolet light in the wavelength range of 315 to 400 nanometers.

Once core roll 12 and glass sleeve 16 have been bonded together, the outer surface of glass sleeve 16 could be ground to tolerance, if required, and the engraving of the ink or liquid capturing cells could be performed on the outer surface by laser, chemical or mechanical means.

The procedure described as the preferred embodiment for the manufacture of a liquid metering roll utilizing a glass sleeve as its outer periphery for receipt of the liquid capturing cells. It would be also possible to bond the glass sleeve to the core by heat treatment and cooling process whereby the glass sleeve were heated to an elevated temperature, the core would be inserted into the glass sleeve and both the core and the glass sleeve would be simultaneously cooled to bond the glass sleeve to the core roll. Utilizing this method, care must be taken that the core roll and the glass sleeve do not become deformed during the heating and cooling process and as such, while this procedure is available, the use of an adhesive bond is the preferable method.

While the present invention has been described with reference to the preferred embodiment thereof, it will be appreciated by those of ordinary skill in the art that various changes can be made in the process and apparatus without departing from the basic spirit and scope of the invention.

What is claimed is:

1. A method of manufacture for a durable metering roll for the application of ink or other liquids, said method comprising:

a. forming a core roll having a constant cross-sectional area;

b. roughening the periphery surface of said core roll in preparation for the application of an adhesive, said roughening of said peripheral surface of said core roll comprising spinning said core roll about its longitudinal axis while simultaneously grit blasting its periphery;

c. forming a concentric sleeve complimentary with said core roll, said concentric sleeve comprised of a non-porous, heat-resistant, transparent glass;

d. abrading the interior, cylindrical surface of said concentric sleeve in preparation for the application of adhesive, said abrading of said interior cylindrical surface of said concentric sleeve comprising the spinning of said concentric sleeve about its longitudinal axis while simultaneously introducing an oxide grit onto the interior cylindrical surface of said concentric sleeve;

e. applying adhesive to the cylindrical periphery of said core roll or to said interior cylindrical surface of said concentric sleeve said adhesive comprising a non-solvent, solid adhesive;

f. positioning said concentric sleeve about said core roll;

g. curing and setting said adhesive, said curing and setting comprising exposing said adhesive to the application of ultraviolet light passing through said non-porous, heat-resistant, transparent glass; and h. engraving distinct ink capturing cells on said peripheral surface of said cylindrical sleeve.

* * * * *